US005936510A

United States Patent [19]

Wehl et al.

[11] Patent Number: 5,936,510

[45] Date of Patent: Aug. 10, 1999

[54] SEALED CASE HOLD OPEN THERMOSTAT

[75] Inventors: Brandon L. Wehl, Canton; James M. Petro, Masillon, both of Ohio

[73] Assignee: Portage Electric Products, Inc., North Canton, Ohio

[21] Appl. No.: 09/083,785

[22] Filed: May 22, 1998

[51] Int. Cl.[6] ..... H01H 37/14; H01H 61/02; H01H 61/00

[52] U.S. Cl. ..... 337/377; 337/380; 337/324; 337/77; 337/100; 337/102; 337/107

[58] Field of Search ..... 337/102, 103, 337/104, 107, 100, 377, 380, 381, 324, 77

[56] References Cited

U.S. PATENT DOCUMENTS

| | | | |
|---|---|---|---|
| 3,223,808 | 12/1965 | Wehl | 200/138 |
| 3,525,914 | 8/1970 | Vind | 318/221 |
| 3,919,679 | 11/1975 | Kingma . | |
| 4,015,229 | 3/1977 | Senor et al. . | |
| 4,086,558 | 4/1978 | Pejouhy et al. . | |
| 4,220,938 | 9/1980 | Grable | 337/89 |
| 4,237,510 | 12/1980 | Thompson, Jr. et al. . | |
| 4,262,273 | 4/1981 | Grable | 337/67 |
| 4,399,423 | 8/1983 | Nield | 337/102 |
| 4,458,231 | 7/1984 | Senor | 337/107 |
| 4,476,452 | 10/1984 | D'Entremont | 337/102 |
| 4,517,541 | 5/1985 | Ubukata et al. | 337/89 |
| 4,755,787 | 7/1988 | Wehl | 337/372 |
| 4,849,729 | 7/1989 | Hofsass | 337/102 |
| 4,862,133 | 8/1989 | Tabei . | |
| 4,878,038 | 10/1989 | Tsai | 337/107 |
| 4,894,634 | 1/1990 | Nezuka et al. | 337/343 |
| 5,103,202 | 4/1992 | Lennon et al. . | |
| 5,233,325 | 8/1993 | Takeda | 337/107 |
| 5,309,131 | 5/1994 | Hofsäss et al. . | |
| 5,607,610 | 3/1997 | Furukawa | 219/505 |
| 5,745,022 | 4/1998 | Becher et al. . | |
| 5,757,262 | 5/1998 | Takeda . | |

*Primary Examiner*—Leo P. Picard
*Assistant Examiner*—Anatoly Vortman
*Attorney, Agent, or Firm*—Darby & Darby

[57] ABSTRACT

A thermostat includes a case having a sealed interior and an exterior. A contact extends from the sealed interior to the exterior. The contact is fixed with respect to the casing and has an interior contact position. A first blade extends from the sealed interior to the exterior and has an interior end. The interior end of the first blade moves between a first position where the interior end of first blade contacts the interior contact position of the contact and a second position where the interior end of the first blade is spaced from the contact position end of the contact. A separator is disposed between the first blade and the contact in the interior of the case. The separator is made of an insulating material. The separator has a first side facing the contact and a second side facing the first blade. A first conductive contact pad is disposed on the first side of the separator. A second conductive contact pad is disposed on the second side of the separator. A resistor disposed within that separator is electrically connected between the first conductive contact pad and the second conductive contact pad. The resistor has sufficient resistance so that when the interior end of the first blade moves from the first position to the second position, sufficient heat is generated by the resistor to maintain the interior end of the first blade in the second position until a load current being applied to the contact and the first blade is removed.

9 Claims, 2 Drawing Sheets

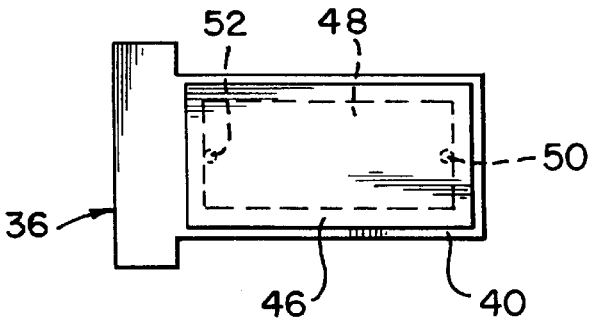
FIG. 3
FIG. 4
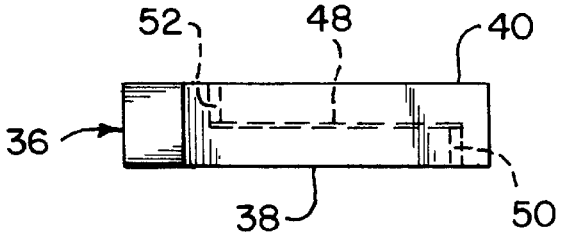
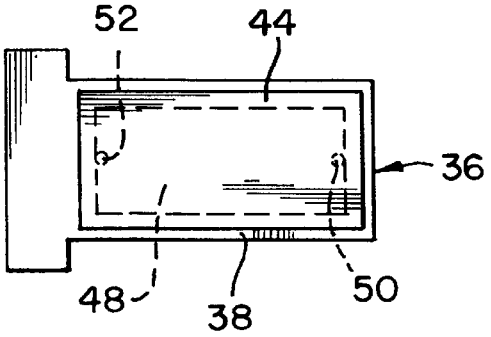
FIG. 5
FIG. 6
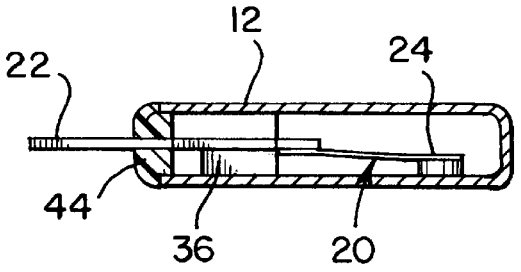

SEALED CASE HOLD OPEN THERMOSTAT

BACKGROUND OF THE INVENTION

1. Field of the Invention

This invention relates generally to bimetal thermostats for use in electric circuits. More specifically, the invention relates to a sealed case thermostat, where, after the thermostat snaps to the open position, the thermostat remains in the open position until the power supplied to the device is turned off or removed.

2. Discussion of the Related Art

Thermostats use a bimetal blade that is essentially two strips of metal having different coefficients of expansion laminated to each other. With an increase in ambient temperature, the blade will bend away from the side containing the material with the higher coefficient of expansion. In the case of a so-called snap action blade, the blade is molded with a formed midsection so that the bending in response to increased temperature will not be gradual, but will occur suddenly once a threshold temperature is achieved. Thus, the blade will "snap" to its bent position.

These bimetal blades are then incorporated into a case and/or placed adjacent another contact so that an electrical connection will be either formed or broken as the bimetal blade bends. This type of thermostat has many applications, but has recently been used extensively in the electronics industry, mainly because of the ability to make these thermostats relatively compact.

Recently, new standards are being considered for motors, transformers, home appliances, etc., where if the device overheats, the thermostat that is mounted within the device, upon reaching the overheated condition, is now required to snap to the open or off position and is, thereafter, required to stay in the open position until either the power supply is removed from the device or a switch is used to turn off the power supply to that device.

U.S. Pat. No. 4,703,298 discloses a thermostat that includes ceramic mounting pins 4, 5 that are made of resistive material. The thermostat is an open-type device and is, therefore, subject to all kinds of atmospheric conditions. Two metal contact carriers 2, 3 are fastened onto parallel pins 4, 5. Carriers 2 and 3 are selectively moveable relative to each other on pins 4 and 5 so that the thermostat can be adjusted for a specific circuit opening temperature. Thus, the thermostat is required to be open to permit the carriers 2, 3 to move with respect to the pins 4, 5.

In use, when the bimetal 7 moves to the open position, a significant current occurs briefly in the pins to rapidly heat the ceramic PTC pin material to its high resistivity temperature to effectively completely open the circuit between carriers 2, 3. After bimetal 7 moves to the open position, a small current continues to flow in the high resistivity pins to generate heat at the stabilizing temperature of the pins. This small current flow is sufficient to maintain the bimetal 7 above its reset temperature even though the ambient temperature being monitored by the thermostat may return to its original or normal level. The thermostat thus remains open until it is manually reset, by disconnecting it from the circuit, to permit pins 3, 4 to cool to their original room temperature resistivity.

For many uses it is desirable for the thermostat to be sealed from the local ambient conditions to ensure the efficient operation of the thermostat. Sealed thermostats can be calibrated or adjusted for a specific circuit opening temperature by distorting the case at a predetermined location as is well known in the art (see, for example, U.S. Pat. Nos. 3,443,259 and 3,223,808 the disclosures of which are hereby incorporated by reference). Thus, it is an object of the present invention to provide a sealed case hold open thermostat.

SUMMARY OF THE INVENTION

In accordance with a currently preferred embodiment of the present invention, a thermostat includes a case having a sealed interior and an exterior. A first blade extends from the sealed interior to the exterior. The first blade is fixed with respect to the casing and has an interior end. A second blade extends from the sealed interior to the exterior and has an interior end. The interior end of the second blade moves between a first position, where the interior end of second blade contacts the interior end of the first blade, and a second position, where the interior end of the second blade is spaced from the interior end of the first blade. A separator is disposed between the first blade and the second blade in the interior of the case. The separator is made of an insulating material and has a first side facing the first blade and a second side facing the second blade. A first conductive contact pad is disposed on the first side of the separator. A second conductive contact pad is disposed on the second side of the separator. A resistor is electronically connected between the first conductive contact pad and the second conductive contact pad. The resistor has sufficient resistance that when the interior end of the second blade moves from the first position to the second position, a sufficient amount of heat is generated by the resistor to maintain the interior end of the second blade in the second position until a load current being applied to the first and second blades is removed.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 3 is a top view of the separator and resistor according to the present invention;

FIG. 4 is a side view of the separator and resistor according to the present invention;

FIG. 5 is a bottom view of the separator and resistor according to the present invention; and FIG. 6 is a cross-sectional view of the thermostat according to a second embodiment of the present invention.

DESCRIPTION OF THE PREFERRED EMBODIMENT

Figure 1:
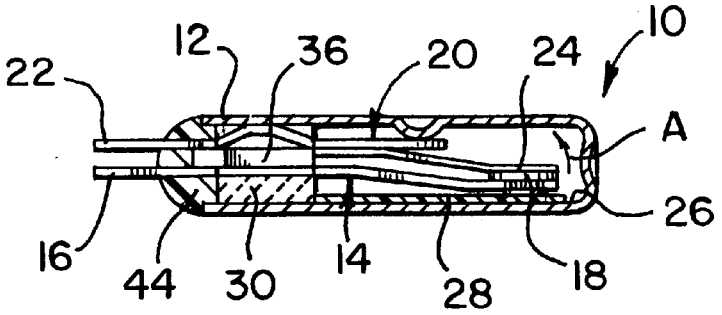
FIG. 1 is a cross-sectional view of the thermostat according to the present invention.
Figure 2:
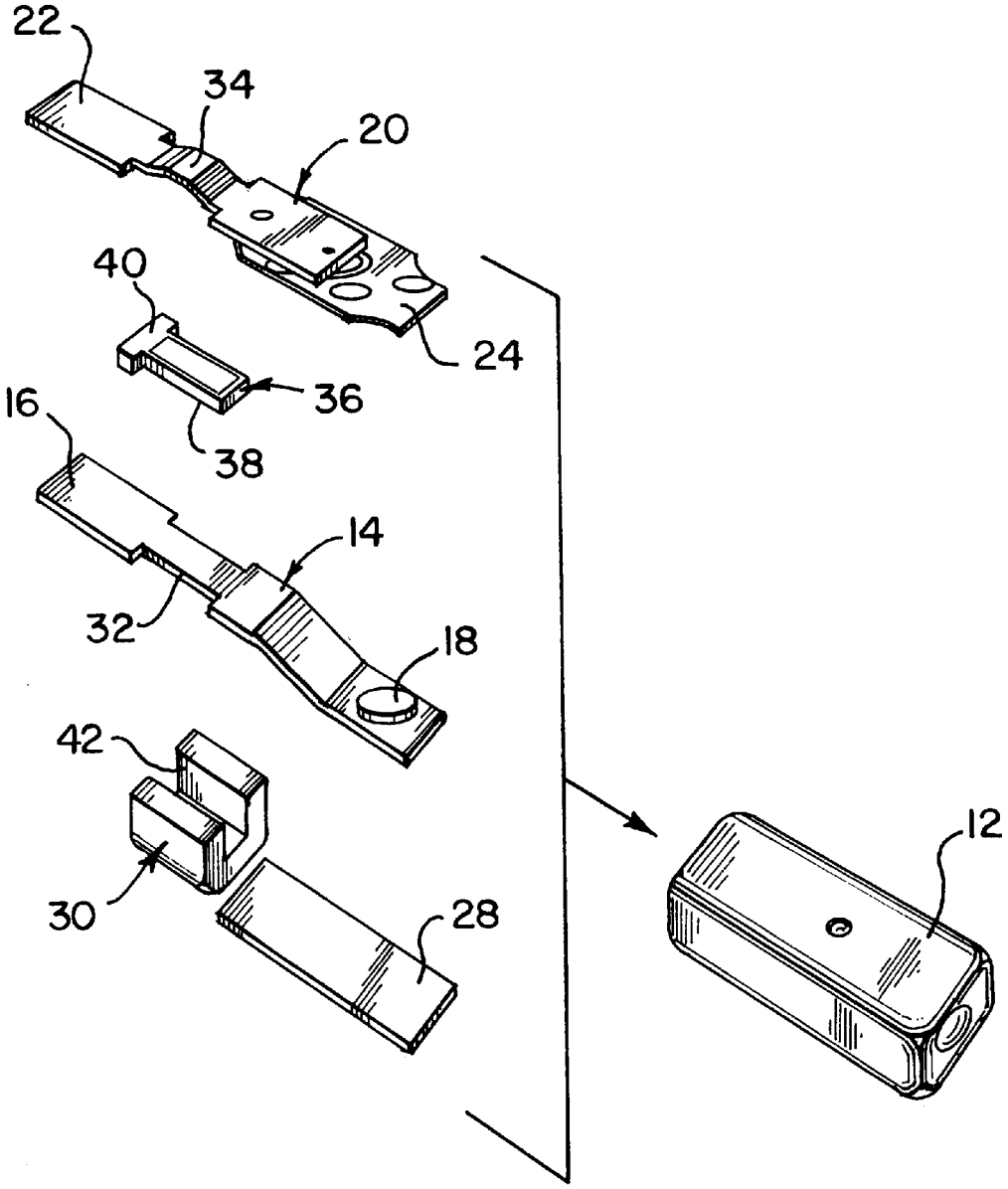
FIG. 2 is an exploded view of the thermostat according to the present invention.

Referring now to FIG. 1, a cross-sectional view of a thermostat 10 according to a preferred embodiment of the invention is shown. Thermostat 10 includes an outer case 12, into which the remaining components are inserted. A first thermostat blade 14 is inserted into case 12. Blade 14 has a first terminal end 16 at the exterior end extending out of case 12, and a contact end 18 at the interior end of the blade 14 disposed in the interior of case 12. A second bimetal blade 20 is also inserted into case 12 with a terminal end 22 at the exterior end of blade 20 extending out of case 12 and an interior end 24 of blade 20 disposed within case 12.

First blade 14 is fixed with respect to case 12. Second blade 20 moves with respect to case 12. The interior end 24 of second blade 20 moves between a first position and a second position. In the first position, the interior end 24 of the second blade 20 contacts the interior end 18 of first blade 14, thereby completing the circuit between terminal end 16 and terminal end 22 (see FIG. 1). Interior end 24 of second blade 20 moves to a second position, in the direction indicated by arrow A in FIG. 1, so that the interior end 24 of second blade 20 is spaced from the interior end 18 of first blade 14 upon the thermostat interior reaching a predetermined circuit opening temperature.

Positioned between an interior wall 26 of case 12 and first blade 14 is an insulator sheet 28 that electrically isolates blade 14 from case 12. Positioned about the mid-section of the two blades 14, 20 is a U-shaped channel insulator 30. U-shaped channel insulator 30 is preferably received about reduced width portions 32 and 34 of the first blade 14 and second blade 20, respectively. Positioned between the reduced width portions 32, 34 is an insulating separator 36 that electrically isolates blade 14 from blade 20. Separator 36 is made of an insulating material, preferably ceramic, and has a first side 38 facing first blade 14 and a second side 40 facing second blade 20. In a currently preferred embodiment, separator 36 is made of calcium borosilicate glass, which is a glass ceramic material. The two blades 14, 20 and the separator 36 all rest and are supported within U-shaped channel 42 of U-shaped channel insulator 30. The entire assembly (i.e., sheet 28, channel 30, blade 14, separator 36 and blade 20) is then inserted into case 12, with the exterior ends 16 and 22 of the first blade 14 and second 20, respectively, disposed exterior to case 12. Case 12 is preferably sealed from the exterior after insertion of the entire assembly with an epoxy 44.

Referring now to FIGS. 3, 4 and 5, a top view, side view and bottom view of separator 36, respectively, is illustrated. A first conductive contact pad 44 is mounted on the first side 38 of separator 36. A second conductive contact pad 46 is mounted on the second side 40 of separator 36. A resistor 48 is disposed within separator 36. As illustrated in FIGS. 3–5, resistor 48 preferably has a rectangular planar shape. Resistor 48 is electrically connected between first contact pad 44 and second contact pad 46 by a first passage 50 and a second passage 52, respectively. Each passage, 50, 52 is filled with a conductive material to electrically connect resistor 48 to the contact pads 44, 46. In a currently preferred embodiment, the contact pads are made of about 80% by weight fused silver powder, with the balance being a calcium borosilicate glass. The passages 50, 52 are preferably filled with 90% by weight fused silver powder, with the balance being calcium borosilicate glass. Resistor 48 is preferably made of about 90% by weight calcium borosilicate glass, with the balance being less than 10% by weight ruthenium dioxide powder and less than 1% by weight manganese dioxide.

In operation, the two terminal contacts 16, 22 of the blades are connected to surrounding circuitry. For example, the thermostat can be mounted in a device, such as an overhead ventilator mounted over a stove, and can be used to disconnect the load current to the ventilator if the surrounding temperature exceeds a predetermined threshold temperature. In other words, as the ambient temperature surrounding the thermostat rises and reaches a predetermined threshold temperature, bimetal blade 20 will bend away from fixed contact blade 14, so that the interior end 24 of second blade 20 is spaced from the interior end 18 of fixed blade 14 to open the circuit between the two terminals 16, 22. Conventionally, once the ambient temperature decreased below the threshold temperature, bimetal plate 14 would bend back toward contact blade 16, thereby closing the circuit once again and permitting the ventilator to operate.

However, in accordance with the present invention, the current being applied to the ventilator, and, thus, the two terminals 16, 22, travels between first blade 14 and second blade 20 via the electrical path created by first contact pad 44, conductive passageway 50, resistor 48, conductive passageway 52 and second contact pad 48. Resistor 48 is of a sufficient resistance that when the second blade is moved to the open position, a sufficient amount of heat is generated by the resistor (e.g., 1 to 5 watts, preferably 4 to 5 watts) to maintain the temperature within case 12 at or above the threshold temperature. Thus, the second blade is maintained in the second open position until the load current being applied to the ventilator is removed, either by turning off the ventilator via a switch or removing the power line cord (i.e., unplugging the device). Thereafter, the thermostat will eventually cool down and reset itself when the ambient temperature falls below the threshold level. The switch for the ventilator can then be turned back on or the power cord can be plugged back in to enable the ventilator to operate once again.

Referring now to FIG. 6, in accordance with an alternative embodiment of the present invention, case 12 is made of conductive material, i.e., it is "live". The case therefore provides the opposite contact for blade 20 for connection to surrounding circuitry. In other words, blade 14 can be eliminated and replaced by the interior case wall. The interior case wall may need to be coated with a silver or gold composition to increase the conductivity of the case. Separator 36 would then be placed between blade 20 and case 12 to electrically isolate these two elements. The remaining operation of the embodiment illustrated in FIG. 6 is similar to the embodiment shown in FIGS. 1–5, including, for example, a resistor being disposed within separator 36.

Having described the presently preferred exemplary embodiment of a sealed case hold open thermostat in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A thermostat comprising:

a case having a sealed interior and an exterior;

a contact extending from said sealed interior to said exterior, said contact being fixed with respect to said casing and having an interior contact position;

a first blade extending from said sealed interior to said exterior, said first blade having an interior end, said interior end of said first blade moving between a first position where said interior end of first blade abuts said interior contact position of said contact and a second position where said interior end of said first blade is spaced from said interior contact position of said contact;

a separator disposed between said contact and said first blade in said interior of said case, said separator being made of an insulating material, said separator having a first side facing said contact and a second side facing said first blade;

a first conductive contact pad disposed on said first side of said separator;

a second conductive contact pad disposed on said second side of said separator;

a resistor disposed within said separator being electrically connected between said first conductive contact pad and said second conductive contact pad, said resistor having a sufficient resistance so that when said interior end of said first blade moves from said first position to said second position a sufficient amount of heat is generated by said resistor to maintain said interior end of said first blade in said second position until a load current being applied to said contact and said first blade is removed.

2. The thermostat as in claim 1, wherein said resistor is made of a ceramic material.

3. The thermostat as in claim 1, wherein said resistor has a planar shape.

4. The thermostat as in claim 2, wherein said resistor has a planar shape.

5. The thermostat as in claim 1, wherein said resistor generates from one to five watts when said interior end of said first blade is in said second position.

6. The thermostat as in claim 5, wherein said amount of heat generated by said resistor is between 4 and 5 watts.

7. The thermostat as in claim 1, wherein said contact is a second blade.

8. The thermostat as in claim 1, wherein said contact is a portion of said case.

9. The thermostat as in claim 1, wherein in said first position essentially no current flows through said resistor, and in said second position current flows through said resistor.

* * * * *